US008678299B2

(12) United States Patent
Ham et al.

(10) Patent No.: US 8,678,299 B2
(45) Date of Patent: Mar. 25, 2014

(54) HOLLOW ACTUATOR-DRIVEN DROPLET DISPENSING APPARATUS

(75) Inventors: Young Bog Ham, Daejeon (KR); Jung Ho Park, Daejeon (KR); So Nam Yun, Daejeon (KR); Sang Gyu Choi, Daejeon (KR)

(73) Assignee: Korea Institute of Machinery & Materials, Daejeon (KR)

( * ) Notice: Subject to any disclaimer, the term of this patent is extended or adjusted under 35 U.S.C. 154(b) by 803 days.

(21) Appl. No.: 12/606,335

(22) Filed: Oct. 27, 2009

(65) Prior Publication Data

US 2010/0102093 A1 Apr. 29, 2010

(30) Foreign Application Priority Data

Oct. 29, 2008 (KR) ..... 10-2008-0106557
Oct. 14, 2009 (KR) ..... 10-2009-0097599

(51) Int. Cl.

| | |
|---|---|
| ***B05B 1/08*** | (2006.01) |
| ***B05B 3/04*** | (2006.01) |
| ***B41J 2/14*** | (2006.01) |
| ***B41J 2/04*** | (2006.01) |

(52) U.S. Cl.
USPC ..... 239/102.2; 239/101; 239/102.1; 347/47; 347/48; 347/54; 347/68

(58) Field of Classification Search
USPC ..... 239/101, 102.1, 102.2; 347/47, 48, 54, 347/68
See application file for complete search history.

(56) References Cited

U.S. PATENT DOCUMENTS

| | | | | |
|---|---|---|---|---|
| 3,683,212 | A * | 8/1972 | Zoltan | 310/328 |
| 3,832,579 | A * | 8/1974 | Arndt | 310/326 |
| 4,278,983 | A * | 7/1981 | Halasz | 347/47 |
| 4,388,627 | A | 6/1983 | Umezawa | |
| 4,395,719 | A * | 7/1983 | Majewski et al. | 347/68 |
| 4,418,354 | A | 11/1983 | Perduijn | |
| 5,113,108 | A * | 5/1992 | Yamashita et al. | 310/328 |
| 5,172,141 | A * | 12/1992 | Moriyama | 347/68 |
| 2002/0168297 | A1 * | 11/2002 | Shvets et al. | 422/100 |
| 2003/0107301 | A1 * | 6/2003 | Asano et al. | 310/328 |
| 2007/0008387 | A1 | 1/2007 | Hopwood et al. | |

FOREIGN PATENT DOCUMENTS

| | | | |
|---|---|---|---|
| CN | 2228810 | Y | 6/1996 |
| JP | 05-064885 | A | 3/1993 |
| JP | 09-070562 | A | 3/1997 |
| JP | 2000310645 | A | 11/2000 |
| JP | 2002-310645 | A | 10/2002 |
| JP | 2003-184754 | | 7/2003 |

(Continued)

*Primary Examiner* — Ryan Reis
(74) *Attorney, Agent, or Firm* — Reinhart Boerner Van Deuren P.C.

(57) ABSTRACT

A hollow actuator-driven droplet dispensing apparatus may include an elastic tube having an elastic body, defining a storage space therein, and extending a predetermined length, and a hollow actuator fitted around the elastic tube so as to generate a force and a displacement in the longitudinal direction when an electric field is applied. The hollow actuator is expanded or contracted in the longitudinal direction of the elastic tube when the external voltage is applied, thereby reducing or enlarging the volume of an inner space of the elastic tube. The droplet dispensing apparatus can press the elastic tube to expand or contract the volume of the inner space of the tube using the hollow actuator capable of quickly generating a displacement in response to an application voltage so that a fixed amount of content can be discharged out and taken into the tube.

20 Claims, 7 Drawing Sheets

(56) References Cited

FOREIGN PATENT DOCUMENTS

| | | | |
|---|---|---|---|
| JP | 2005-241263 | | 9/2005 |
| JP | 2005305396 | A | 11/2005 |
| JP | 2006-521541 | | 9/2006 |
| JP | 2008-145434 | | 6/2008 |
| KR | 20030048515 | A | 6/2003 |
| KR | 20060087553 | A | 8/2006 |
| KR | 20070076780 | A | 7/2007 |
| WO | WO 2004/086054 | A1 | 10/2004 |

* cited by examiner

HOLLOW ACTUATOR-DRIVEN DROPLET DISPENSING APPARATUS

CROSS REFERENCE TO RELATED APPLICATION

The present application claims priority to Korean Patent Application Number 10-2008-0106557 filed on Oct. 29, 2008 and Korean Patent Application Number 10-2009-0097599 filed on Oct. 14, 2009, the entire contents of which application is incorporated herein for all purposes by this reference.

BACKGROUND OF THE INVENTION

1. Field of the Invention

The present invention relates to a droplet dispensing apparatus for precisely dispensing a fixed amount of droplets, and more particularly, to a hollow actuator-driven droplet dispensing apparatus, which includes a tube and a hollow laminated piezoelectric actuator, the piezoelectric actuator constructed by stacking multiple layers of piezoelectric devices, on each of which an electrode is coated, on opposite end surfaces of a hollow piezoelectric ceramic body, such that the tube can be expanded and contracted in response to longitudinal expansion and contraction of the piezoelectric devices so as to take in or dispense content.

The hollow actuator-driven droplet dispensing apparatus of the present invention can precisely control the amount of content to be dispensed from the tube by controlling a voltage supplied to the piezoelectric devices since the actuator is constructed of hollow laminated piezoelectric devices.

2. Description of Related Art

Micro-droplet jetting is applicable to various industries such as precision machines, semiconductors, chemical process equipment, and medical and biological industries. In particular, micro-droplet jetting can be applicable to a fabrication process of next-generation semiconductors and displays. In addition, this technology is applicable to a variety of packages, super-precision color patterning, digital textile printing, molding of miniature parts, chemical analysis equipment, and biochips/biosensors. Micro-droplet jetting is one of the key process technologies in terms of product yield and productivity.

For such micro-droplet jetting, a dispensing method is generally used, to which a pneumatic drive using compressed air and an electronic valve is applied. However, precision is reduced due to the compressibility of air and equipment life is reduced due to nozzle clogging, thereby increasing production cost.

In order to compensate for such drawbacks, a dispensing apparatus for jetting droplets was developed, which is constructed of piezoelectric devices.

A dispenser, based on piezoelectric devices, applies bending strain of a thin disk-type piezoelectric device or actuates a metal diaphragm using the longitudinal displacement of a laminated piezoelectric actuator. However, the existing dispenser has a complicated structure and is bulky.

The information disclosed in this Background of the Invention section is only for enhancement of understanding of the background of the invention and should not be taken as an acknowledgment or any form of suggestion that this information forms the prior art that is already known to a person skilled in the art.

BRIEF SUMMARY OF THE INVENTION

Various aspects of the present invention provide a hollow actuator-driven droplet dispensing apparatus, which can respond more accurately and quickly using a drive means constructed with a hollow actuator that can generate a great amount of force at a high response rate.

There is also provided a hollow actuator-driven droplet dispensing apparatus, which includes a tube and a hollow laminated piezoelectric actuator, the piezoelectric actuator constructed by stacking multiple layers of piezoelectric devices, on each of which an electrode is coated, on opposite end surfaces of a hollow piezoelectric ceramic body, such that the tube can be expanded and contracted in response to longitudinal expansion and contraction of the piezoelectric devices so as to take in or dispense content.

In an aspect of the invention, the droplet dispensing apparatus may include an elastic tube having an elastic body, defining a storage space therein, and extending a predetermined length; and a hollow actuator fitted around the elastic tube so as to expand and contract the elastic tube in a longitudinal direction of the elastic tube when an external voltage is applied and to generate a force and a displacement in the longitudinal direction when an electric field is applied. The hollow actuator is expanded or contracted in the longitudinal direction of the elastic tube when the external voltage is applied, thereby reducing or enlarging the volume of an inner space of the elastic tube.

In an exemplary embodiment of the invention, the elastic tube may include a deforming part provided on an outer surface of the body, corresponding to the hollow actuator. The deforming part has a bellows-like configuration.

In an exemplary embodiment of the invention, the elastic tube may have a female thread member screw-engaged with a male thread part, which is formed on an outer surface of the body of the elastic tube. The female thread member is in contact with one end of the hollow actuator.

In an exemplary embodiment of the invention, the elastic tube may also include a protective case. The protective case has an upper opening fixedly fitted around an inlet of the elastic tube and a lower opening spaced at a predetermined interval from an outlet of the elastic tube In an exemplary embodiment of the invention, the elastic tube may include a deforming part provided on an outer surface of the body, corresponding to the hollow actuator. The deforming part includes a central portion having a constant inner diameter and extending a predetermined length, a first boundary portion connecting the central portion to an inlet and having a cross section reducing in diameter toward the inlet, and a second boundary portion connecting the central portion to an outlet and having a cross section reducing in diameter toward the outlet.

In an exemplary embodiment of the invention, the droplet dispensing apparatus may also include an upper flange screw-engaged with a male thread part formed on an outer surface of an inlet of the elastic tube and a lower flange screw-engaged with a male thread part formed on an outer surface of an outlet of the elastic tube. The upper flange is in contact with an upper end of the hollow actuator, and the lower flange is in contact with a lower end of the hollow actuator.

In an exemplary embodiment of the invention, the elastic tube may include one or more deforming parts provided on outer surfaces of the body, corresponding to the hollow actuator. The outer diameter of the deforming part is smaller than that of an inlet and an outlet, and the outer surface of the deforming part is curved outward to form a convex cross section.

In an exemplary embodiment of the invention, the droplet dispensing apparatus may also include an upper flange screw-engaged with a male thread part formed on an outer surface of an inlet and a lower flange extending outward from an outlet of the elastic tube. The upper flange is in contact with one end of the hollow actuator, and the lower flange is in contact with the other end of the hollow actuator.

In an exemplary embodiment of the invention, the droplet dispensing apparatus may also include a discharge nozzle provided on the outlet of the elastic tube.

In an exemplary embodiment of the invention, the droplet dispensing apparatus may also include elastic molding injected between the elastic tube and the hollow actuator.

In an exemplary embodiment of the invention, the droplet dispensing apparatus may also include a backflow preventer provided on the inlet of the elastic tube.

According to embodiments of the invention, the hollow actuator-driven droplet dispensing apparatus can press the elastic tube to expand or contract the volume of the inner space of the tube using the hollow actuator capable of quickly generating a displacement in response to an application voltage so that a fixed amount of content can be discharged out and taken into the tube. Accordingly, the hollow actuator-driven droplet dispensing apparatus can reduce manufacturing costs due to a simple entire structure and a simple assembly structure, be adaptable to the design of a light and thin profile due to its small volume, and have a high response rate.

Furthermore, the hollow actuator-driven droplet dispensing apparatus is easily applicable to dispensing high-viscosity liquid by a strong force generated in vertical and horizontal directions when the hollow actuator is expanded and contracted in the longitudinal direction of the elastic tube. In addition, the amount of content to be dispensed outward can be precisely controlled by a force and a displacement that are in proportion to a voltage applied to the hollow actuator (or a tubular actuator).

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

BRIEF DESCRIPTION OF THE DRAWINGS

FIGS. 2A and 2B are longitudinal cross-sectional views each illustrating an operating state of the dispensing apparatus shown in FIG. 1, wherein FIG. 2A shows an intake state, and FIG. 2B shows a discharge state;

FIGS. 4A and 4B are longitudinal cross-sectional views each illustrating an operating state of the dispensing apparatus shown in FIG. 3, wherein FIG. 4A shows an intake state, and FIG. 4B shows a discharge state;

FIGS. 6A and 6B are longitudinal cross-sectional views each illustrating an operating state of the dispensing apparatus shown in FIG. 5, wherein FIG. 6A shows an intake state, and FIG. 6B shows a discharge state.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
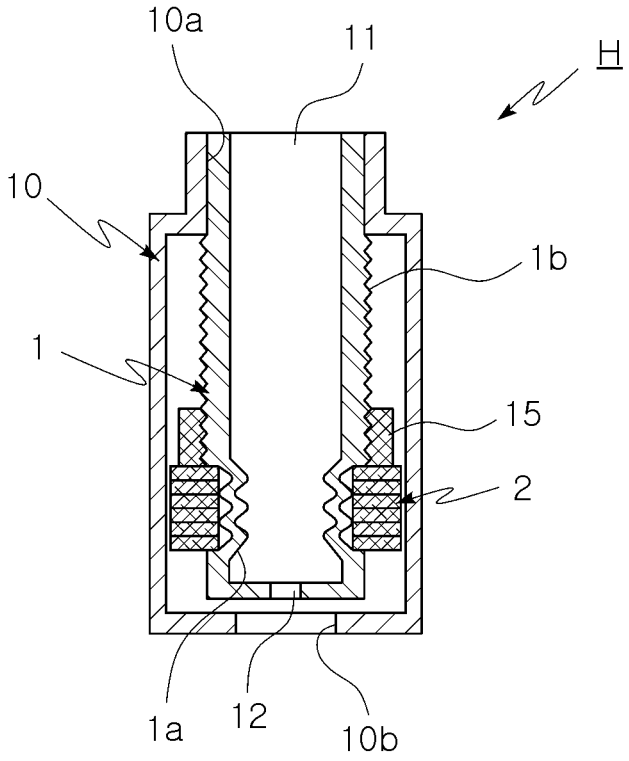
FIG. 1 is a longitudinal cross-sectional view illustrating a dispensing apparatus in accordance with a first exemplary embodiment of the invention.
Figure 2A:
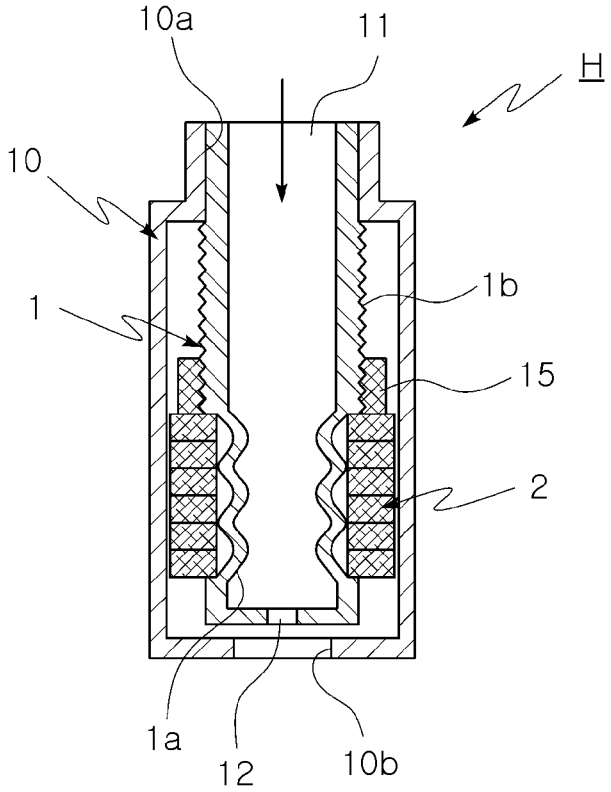
Figure 2B:
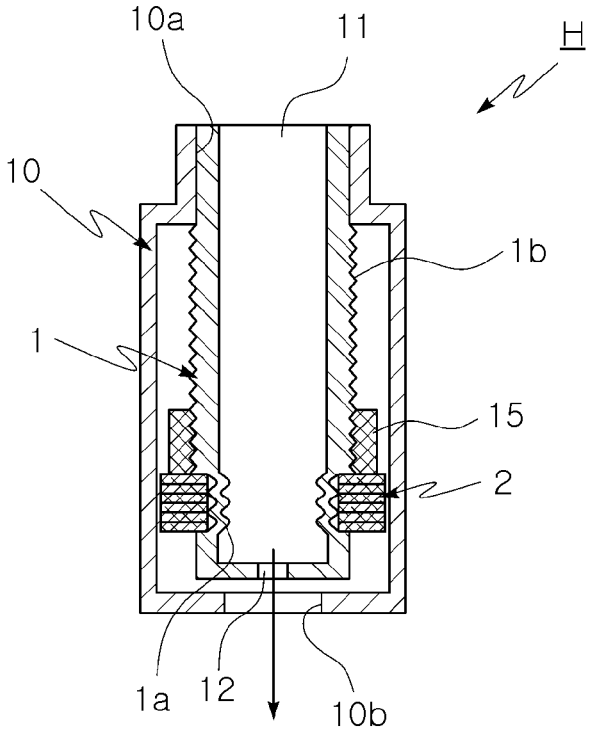

FIG. 1 is a longitudinal cross-sectional view illustrating a dispensing apparatus H in accordance with a first exemplary embodiment of the invention, and FIGS. 2A and 2B are longitudinal cross-sectional views each illustrating an operating state of the dispensing apparatus H shown in FIG. 1, wherein FIG. 2A shows an intake state, and FIG. 2B shows a discharge state.

Referring to FIGS. 1, 2A and 2B, the hollow actuator-driven dispensing apparatus H in accordance with the first exemplary embodiment of the invention includes an elastic tube 1 and a hollow actuator 2.

The elastic tube 1 can be made of a hollow elastic body having a predetermined length, which can be elastically deformed by an external force. The hollow elastic body of the elastic tube 1 defines therein an inner space that can contain content such as liquid or powder.

The hollow actuator 2 is a drive means, which is fixedly fitted around the body of the elastic tube 1 and is electrically connected with an external power supply. When a supply voltage is applied, the hollow actuator 2 generates an external force to elastically deform the entire or a specific part of the elastic tube 1 while being expanded or contracted in the longitudinal direction of the elastic tube 1.

The elastic tube 1 is a means for containing and discharging content such as liquid or powder to be dispensed, and can be made of a metal that has excellent elastic deformation.

As shown in FIG. 1, the elastic tube 1 has a deforming part 1*a* on the outer portion of the body corresponding to the position where the hollow actuator 2 is arranged. The deforming part 1*a* is elastically deformable when an external force is applied.

The deforming part 1*a* can have a bellows-like longitudinal cross section composed of oblique sections or waved sections, which periodically repeat, in order to maximize the longitudinal displacement. The deforming part 1*a* can be formed by performing a mechanical process such as cutting or milling on the outer surface of the body of the elastic tube 1.

Accordingly, when the hollow actuator 2 is expanded and contracted in the longitudinal direction in response to a voltage applied thereto, the elastic tube 1 is elastically deformed so that a change in volume occurs by reducing the diameter of the hollow space inside the central portion of the body of the elastic tube 1. The elastic deformation can be easily enhanced by the deforming part 1*a* having the bellows-like configuration.

A male thread part 1*b* is formed on the outer surface of the body of the elastic tube 1, and a female thread member 15 is meshed with the male thread part 1*b* so as to move along the outer surface of the body of the elastic tube.

Accordingly, when the female thread member 15 is screwed along the male thread part 1*b* while keeping in contact with one end of the hollow actuator 2 arranged on the outer surface of the body of the elastic tube 1, the actuator 2 can be subjected to compressive pre-load while being pressed in the screwing direction and, at the same time, the deforming part 1*a* can be subjected to compressive pre-load. Otherwise, the actuator 2 does not easily move since the other end is in contact with the elastic tube 1.

At this time, it is required to arrange the actuator 2 in such a fashion that the actuator 2 is not easily movable, particularly, by locating the other end of the actuator 2 to be in contact with a stepped portion, which is recessed into or protrudes from the outer surface of the body of the elastic tube 1.

Although the female thread member 15 has been illustrated and described as being meshed with the male thread part, formed on the outer surface of the body of the elastic tube 1 above the deforming part 1*a*, so as to be screwed downward from above, this is not intended to be limiting. Rather, the female thread member 15 can alternatively be meshed with a male thread part formed on the outer surface of the body of the elastic tube below the deforming part so as to be screwed upward from below.

One end, i.e. the upper end, of the actuator 2 is in contact or integrally connected with a specific portion of the elastic tube 1 or the female thread member 15, and the other end, i.e. the lower end, of the actuator 2 is in contact or integrally connected with a specific portion of the elastic tube 1.

In addition, the hollow actuator 2 can be a hollow piezoelectric stack, which is constructed by stacking multiple layers of piezoelectric devices, on each of which an electrode is coated, on opposite end surfaces of a thin ceramic sheet. However, this is not intended to be limiting. Rather, the hollow actuator can be selected from an electro-magnetic actuator, an electric polymer actuator, a shape memory alloy actuator, an electric motor-driven linear actuator, and the like, which can generate a force and displacement in the longitudinal direction when a voltage is applied.

In addition, as shown in FIGS. 1, 2A, and 2B, a protective case 10 can be provided in order to protect the hollow actuator 2 and the elastic tube 1 from the external environment.

The protective case 10 has an upper opening 10*a* and a lower opening 10*b*. The upper opening 10*a* is fixed to the outer surface of an inlet 11, through which content is introduced into the elastic tube 1. The lower opening 10*b* is spaced at a predetermined interval from an outlet 12, through which content is dispensed from the elastic tube 1. The protective case 10 can protect both the elastic tube 1 and the hollow actuator 2 from the external environment when the elastic tube 1 and the hollow actuator 2 are arranged inside an inner space of the protective case 10.

The outlet 12 of the elastic tube 1 is opposite to the lower opening 10*a* of the protective case 10 at a predetermined interval and is arranged on the same imaginary vertical axis as the lower opening 10*a* of the protective case 10. The inner diameter of the lower opening 10*b* is the same as or greater than that of the outlet 12 such that content discharged from the outlet 12 of the elastic tube 1 can be discharged out of the protective case 10 through the lower opening 10*b*.

Accordingly, when content is dispensed through the outlet 12, the nozzle tip, of the elastic tube 1, even if the lower end of the elastic tube 1 is vibrated in the vertical direction by microscopic displacement resulting from repeated expansion and contraction of the hollow actuator 2, the lower end of the elastic tube 1 does not come into contact with the protective case 10, and the interval between the lower end of the protective case 10 and a subject such as a substrate, onto which content dispensed from the outlet 12 will drop, can be maintained to be constant. As a result, droplets, i.e. dispensed content, can be stably dispensed to an intended position.

A cable member (not shown), which is electrically connected to the hollow actuator 2 to supply power, extends outside through the protective case 10.

Figure 3:
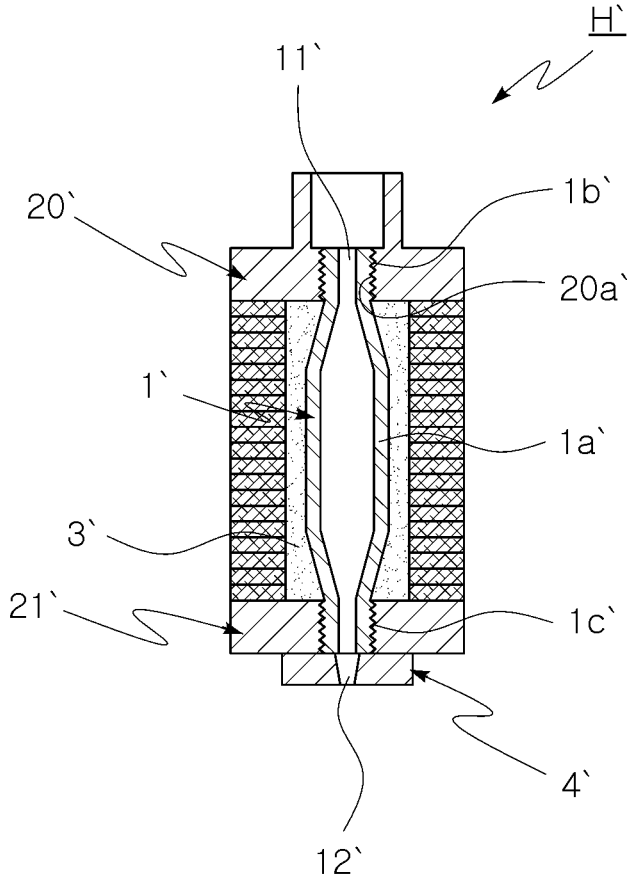
FIG. 3 is a longitudinal cross-sectional view illustrating a dispensing apparatus in accordance with a second exemplary embodiment of the invention.
Figure 4A:
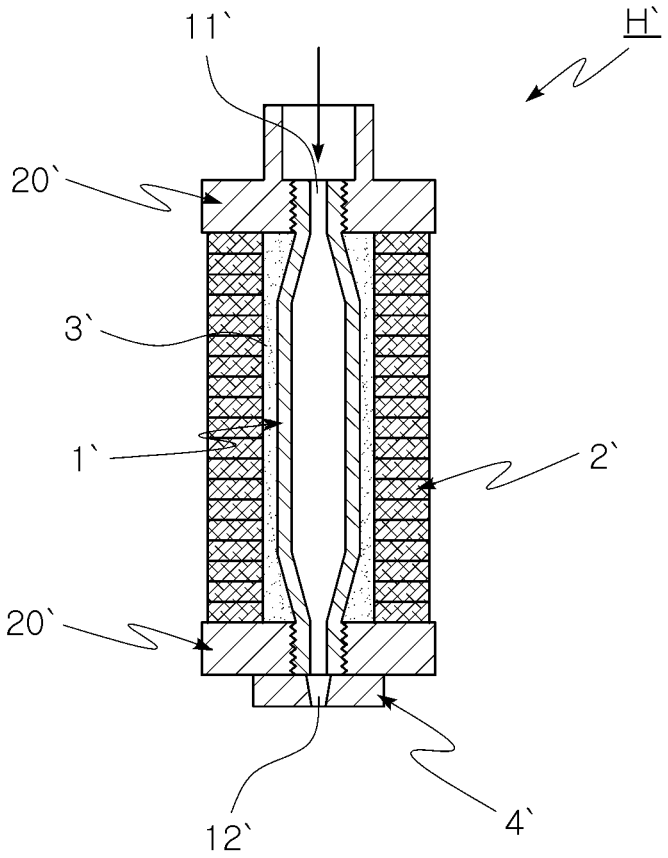
Figure 4B:
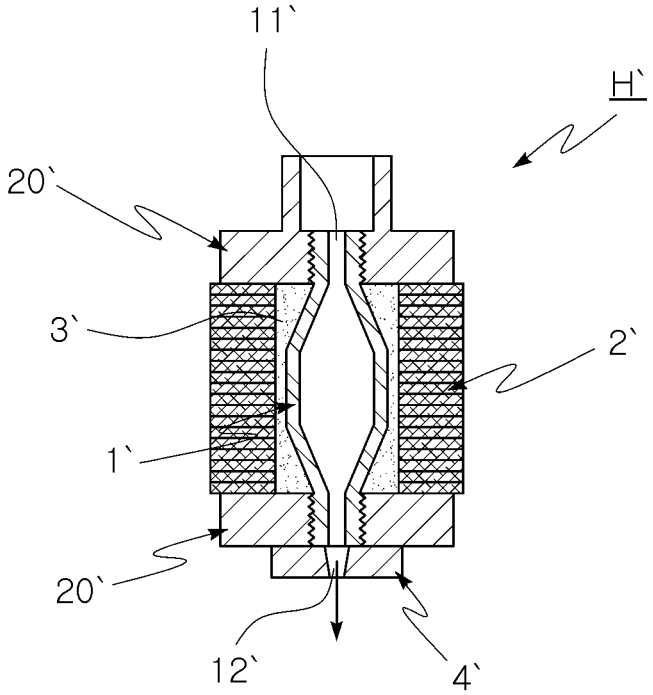

FIG. 3 is a longitudinal cross-sectional view illustrating a dispensing apparatus H' in accordance with a second exemplary embodiment of the invention, and FIGS. 4A and 4B are longitudinal cross-sectional views each illustrating an operating state of the dispensing apparatus H' shown in FIG. 3, wherein FIG. 4A shows an intake state, and FIG. 4B shows a discharge state.

Referring to FIGS. 3, 4A, and 4B, the hollow actuator-driven dispensing apparatus H' in accordance with the second exemplary embodiment of the invention includes an elastic tube 1' and a hollow actuator 2'.

The elastic tube 1' is a hollow elastic body having a predetermined length, which can be elastically deformed by an external force. The hollow elastic body of the elastic tube 1' defines therein an inner space that can contain content such as liquid or powder. The hollow actuator 2' is a drive means, which generates an external force to elastically deform the entire part or a specific part of the elastic tube 1' while being expanded or contracted in the longitudinal direction of the elastic tube 1' when a supply voltage is applied.

As shown in FIG. 3, the elastic tube 1' has a deforming part 1*a'* on the outer portion of the body corresponding to the position where the hollow actuator 2' is arranged. The deforming part 1*a'* is elastically deformable when an external force is applied.

The deforming part 1*a'* includes a central portion having a constant inner diameter and extending a predetermined length, a first boundary portion connecting the central portion to an inlet 11', and a second boundary portion connecting the central portion to an outlet 12'. The cross section of the first boundary portion is reduced in diameter toward the inlet 11', and the cross section of the second boundary portion is reduced in diameter toward the outlet 12'. With this configuration, the deforming portion 1' has a cross section, which is relatively wider than that of the inlet 11' and the outlet 12'.

Accordingly, when the hollow actuator 2' is expanded and contracted in the longitudinal direction in response to a voltage applied thereto, the elastic tube 1' is elastically deformed so that a change in volume occurs by reducing the diameter of the hollow space inside the central portion of the body of the elastic tube 1'. The elastic deformation can be easily enhanced by the deforming part 1*a'*, the inner diameter of which is greater than that of the inlet and the outlet.

The deforming part 1*a'* can have a bellows-like cross section as disclosed above in the first exemplary embodiment.

The dispensing apparatus H' in accordance with the second exemplary embodiment of the invention also includes upper and lower flanges 20' and 21'. The upper and lower flanges 20' and 21' have female thread holes, with which the male threads 1*b'* and 1*c'* formed on the outer surfaces of the inlet 11' and the outlet 12' of the elastic tube 1' are screw-engaged, respectively. The upper and lower flanges 20' and 21' are movable along the outer surface of the body of the elastic tube 1', and are in contact with the upper and lower ends of the hollow actuator 2', respectively. The hollow actuator 2' is arranged to surround the elastic tube 1', between the upper flange 20' screw-engaged with the inlet 11' of the elastic tube 1' and the lower flange 21' screw-engaged with the outlet 12' of the elastic tube 1'.

Accordingly, when one of the upper and lower flanges 20' and 21' is screwed along the male threads 1*b'* or 1*c'* while keeping in contact with the upper or lower end of the hollow actuator 2', the hollow actuator 2' can be subjected to compressive pre-load while being pressed in the screwing direction.

In addition, the hollow actuator 2' is arranged with a predetermined interval from the deforming part 1*a'* of the elastic tube 1' to surround the deforming part 1*a*', and can be expanded and contracted not only in the longitudinal direction but also in the radial direction when a voltage is applied. When elastic molding 3' is injected into the space between the hollow actuator 2' and the elastic tube 1', the displacements in the longitudinal direction and the radial direction of the hollow actuator 2' can be delivered to the deforming part 1*a*' through the elastic molding 3' to dispense content from the elastic tube 1' to the outside through the outlet 12' or to enhance the operation of taking in content through the inlet 11'.

Furthermore, a discharge nozzle 4' can be provided on the outlet 12' of the elastic tube 1' in order to more precisely control the direction or amount of content to be discharged.

Figure 5:
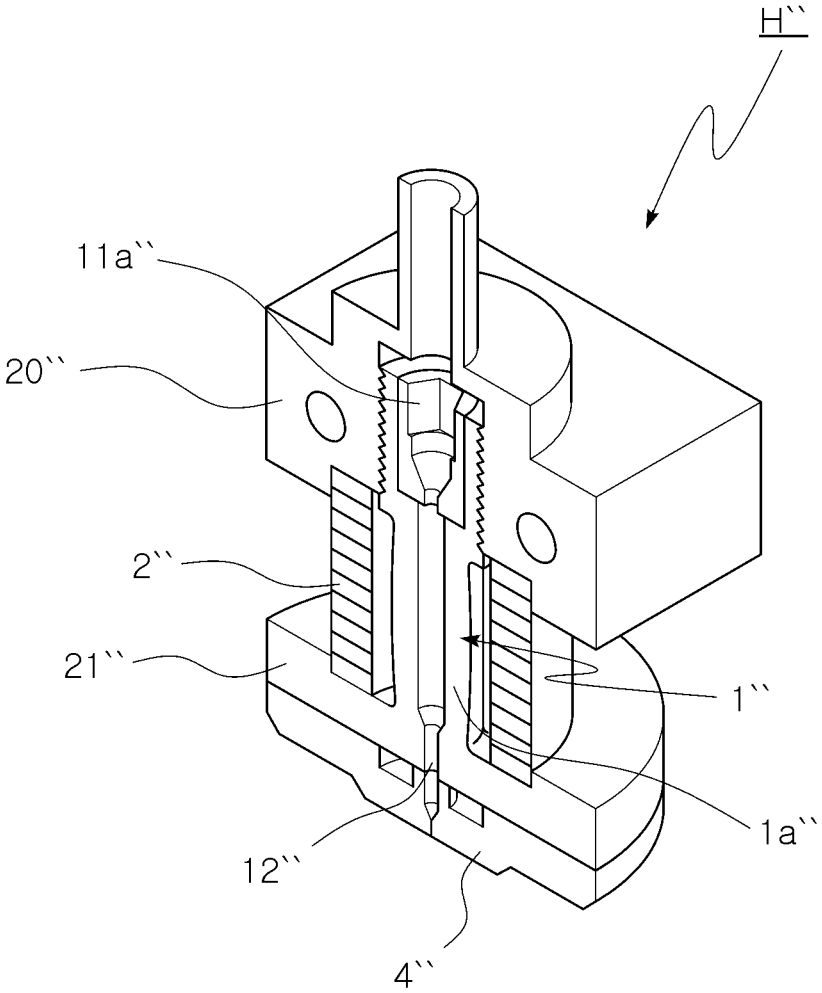
FIG. 5 is a longitudinal cross-sectional view illustrating a dispensing apparatus in accordance with a third exemplary embodiment of the invention.
Figure 6A:
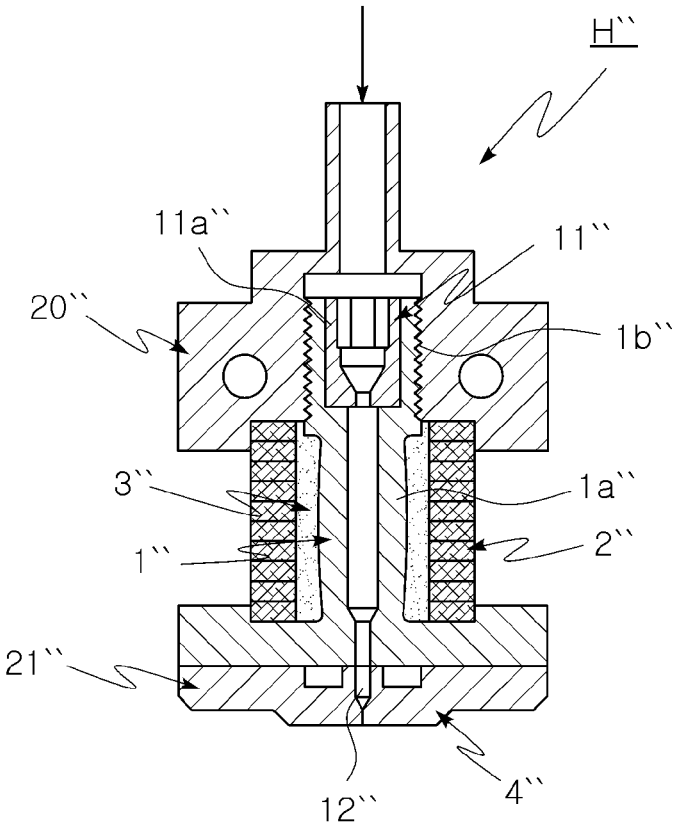
Figure 6B:
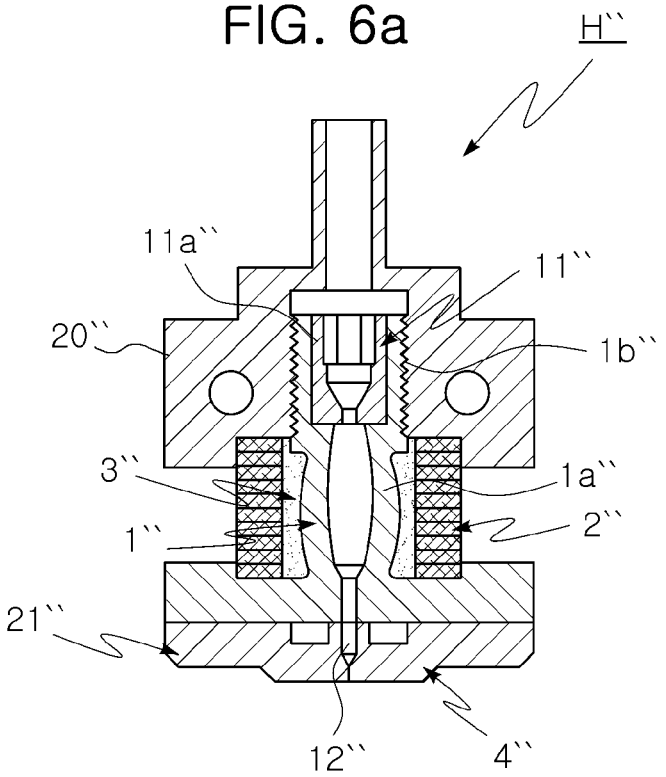
Figure 7:
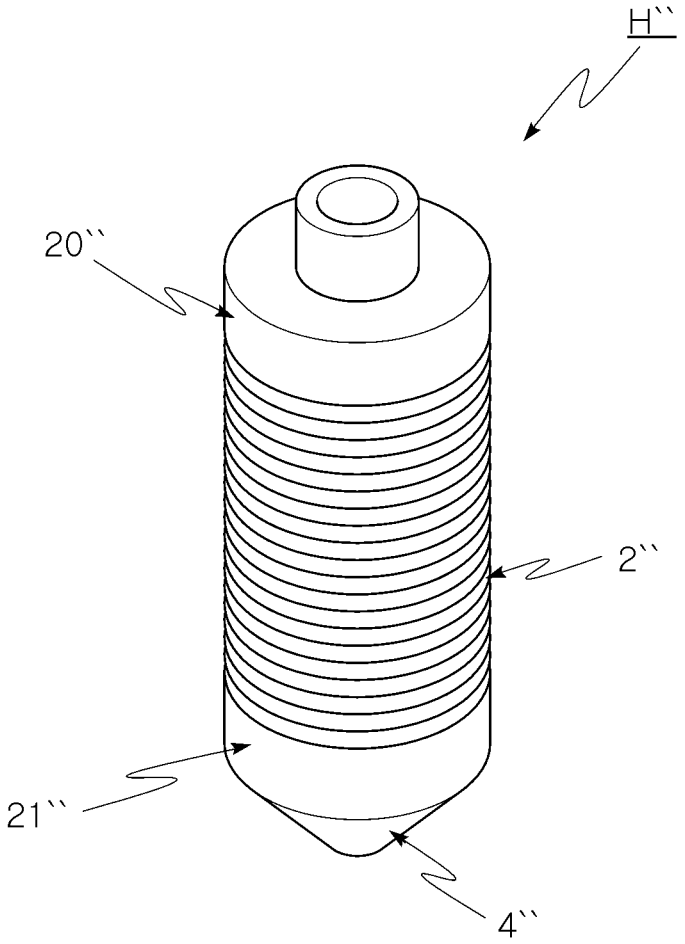
FIG. 7 is a perspective view illustrating the dispensing apparatus shown in FIG. 5.

FIG. 5 is a longitudinal cross-sectional view illustrating a dispensing apparatus H" in accordance with a third exemplary embodiment of the invention, FIGS. 6A and 6B are longitudinal cross-sectional views each illustrating an operating state of the dispensing apparatus H" shown in FIG. 5, wherein FIG. 6A shows an intake state, and FIG. 6B shows a discharge state, and FIG. 7 is a perspective view illustrating the dispensing apparatus shown in FIG. 5.

Referring to FIGS. 5 to 7, the hollow actuator-driven dispensing apparatus H" in accordance with a third exemplary embodiment of the invention includes an elastic tube 1" and a hollow actuator 2" like the first and second exemplary embodiments.

The elastic tube 1" is a hollow elastic body having a predetermined length, which can be elastically deformed by an external force. The hollow elastic body of the elastic tube 1" defines therein an inner space that can contain content such as liquid or powder. The hollow actuator 2" is a drive means, which generates an external force to elastically deform the entire part or a specific part of the elastic tube 1" while being expanded or contracted in the longitudinal direction of the elastic tube 1" when a supply voltage is applied.

As shown in FIG. 5, the elastic tube 1" has a deforming part 1*a*" on the outer portion of the body corresponding to the position where the hollow actuator 2" is arranged. The deforming part 1*a*" is elastically deformable when an external force is applied.

The outer diameter of the deforming part 1*a*" is smaller than that of the inlet 11" and the outlet 12", and the outer surface of the deforming part 1*a*" is curved outward to form a convex cross section.

Accordingly, when the hollow actuator 2" is expanded and contracted in the longitudinal direction in response to a voltage applied thereto, the elastic tube 1" is elastically deformed so that a change in volume occurs by reducing the diameter of the hollow space inside the central portion of the body of the elastic tube 1". The elastic deformation can be easily enhanced by the deforming part 1*a*", the outer diameter of which is smaller than that of the inlet and the outlet.

The deforming part 1*a*" can have a bellows-like cross section as disclosed above in the first exemplary embodiment or a cross section as disclosed above in the second exemplary embodiment, in which the inner diameter is expanded more than the inlet and the outlet.

The dispensing apparatus H" in accordance with the third exemplary embodiment of the invention also includes an upper flange 20" and a lower flange 21". The upper flange 20" has a female thread hole, with which the male threads 1*b*" formed on the outer surface of the inlet 11" of the elastic tube 1" are screw-engaged. The upper flange 20' is movable along the outer surface of the body of the elastic tube 1" to come into contact with the upper end of the hollow actuator 2". The lower flange 21" extends in the outward radial direction from the outlet 12" of the elastic tube 1" and is in contact with the lower end of the hollow actuator 2". The hollow actuator 2" is arranged to surround the elastic tube 1", between the upper flange 20" screw-engaged with the inlet 11" of the elastic tube 1" and the lower flange 21" integrally provided on the outlet 12" of the elastic tube 1".

Accordingly, when one of the upper flange 20" is screwed along the male threads 1*b*" while the upper and lower flanges 20" and 21" keep in contact with the upper or lower end of the hollow actuator 2", the hollow actuator 2" can be subjected to compressive pre-load while being pressed in the screwing direction.

In addition, the hollow actuator 2" is arranged with a predetermined interval from the deforming part 1*a*" of the elastic tube 1" to surround the deforming part 1*a*", and can be expanded and contracted not only in the longitudinal direction but also in the radial direction when a voltage is applied. When elastic molding 3" is injected into the space between the hollow actuator 2" and the elastic tube 1", the displacements in the longitudinal direction and the radial direction of the hollow actuator 2" can be delivered to the deforming part 1*a*" through the elastic molding 3" to dispense content from the elastic tube 1" to the outside through the outlet 12" or to enhance the operation of taking in content through the inlet 11".

Furthermore, a discharge nozzle 4" can be provided on the outlet 12" of the elastic tube 1" in order to more precisely control the direction or amount of content to be discharged.

As shown in FIGS. 2A, 2B, 4A, 4B, 6A, and 6B, the hollow actuator-driven droplet dispensing apparatuses, in accordance with the first to third exemplary embodiments of the invention, repeatedly perform micro-pumping by every expansion/contraction of the hollow actuator, corresponding to the deforming part of the elastic tube. In the micro-pumping, the hollow actuator is elastically expanded and contracted in the longitudinal direction to take content into the elastic tube from outside while dispensing a preset amount of content.

Specifically, as shown in FIGS. 2A, 4A, and 6A, when the hollow actuator is expanded in the longitudinal direction, the volume of the inner space of the elastic tube is expanded more than the initial standby state so that content is introduced through the inlet. At this time, although the hollow actuator is contracted in the radial direction while being expanded in the longitudinal direction, the inner space of the elastic tube is enlarged since the amount of elastic expansion in the longitudinal direction is greater than the amount of elastic contraction in the radial direction, thereby facilitating the intake operation of content.

In addition, as shown in FIGS. 2B, 4B, and 6B, when the hollow actuator is contracted in the longitudinal direction in the state where the inner space of the elastic tube is filled with content such as liquid or powder, the deforming part of the elastic tube elastically deformed in the longitudinal direction returns to the original state from the deformed state while being contracted in the longitudinal direction, and the volume of the inner space of the elastic tube becomes the same as or smaller than the initial standby state, so that a preset amount of content can be dispensed through the outlet. At this time, although the hollow actuator is contracted in the longitudinal direction while being expanded in the radial direction, the inner space of the elastic tube is reduced since the amount of elastic contraction in the longitudinal direction is greater than the amount of elastic expansion in the radial direction, thereby facilitating the dispensing operation of content.

It is possible to precisely provide a preset amount of content from the elastic tube to an intended place by repeating the intake and dispensing operations of the elastic tube based on the expansion and contraction of the hollow actuator.

In addition, a backflow preventer 11*a*" such as an orifice can be provided on the inlet of the elastic tube in order to prevent content such as liquid or powder from flowing back toward the inlet once introduced into the elastic tube.

Specifically, the backflow preventer 11*a*" is in the shape of an orifice, which has a passage with an inner diameter decreasing toward the elastic tube and a protrusion formed on the inner end. With this configuration, the backflow preventer 11*a*" can prevent content from flowing back using the protrusion on the inner end.

The backflow preventer 11*a*" can be selectively implemented as a backflow prevention plate in place of the orifice in order to enhance the backflow prevention effect.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A droplet dispensing apparatus, comprising:

an elastic tube having an elastic body, defining a storage space therein, and extending a predetermined length, and including a deforming part provided on an outer surface of the elastic body; and a hollow actuator including a hollow piezoelectric stack which is constructed by stacking multiple layers of piezoelectric devices, wherein each of the piezoelectric devices is made by coating opposite surfaces of a thin ceramic sheet with an electrode, and making a hole through the thin ceramic sheet and the hole of each of the piezoelectric devices is directly coupled to the outer surface of the elastic tube so as to expand and contract the elastic tube in a longitudinal direction of the elastic tube when an external voltage is applied and to generate a force and a displacement in the longitudinal direction when an electric field is applied, wherein the hollow actuator is expanded or contracted in the longitudinal direction of the elastic tube when the external voltage is applied, thereby reducing or enlarging the volume of an inner space of the elastic tube.

2. The droplet dispensing apparatus in accordance with claim 1, wherein the deforming part has a bellows-like configuration.

3. The droplet dispensing apparatus in accordance with claim 1, wherein the elastic tube has a female thread member screw-engaged with a male thread part, which is formed on the outer surface of the body of the elastic tube, the female thread member being in contact with one end of the hollow actuator.

4. The droplet dispensing apparatus in accordance with claim 1, wherein the elastic tube further includes a protective case, wherein the protective case has an upper opening fixedly fitted around an inlet of the elastic tube and a lower opening spaced at a predetermined interval from an outlet of the elastic tube.

5. The droplet dispensing apparatus in accordance with claim 1, wherein the deforming part includes a central portion having a constant inner diameter and extending a predetermined length, a first boundary portion connecting the central portion to an inlet and having a cross section reducing in diameter toward the inlet, and a second boundary portion connecting the central portion to an outlet and having a cross section reducing in diameter toward the outlet.

6. The droplet dispensing apparatus in accordance with claim 1, further comprising:

an upper flange screw-engaged with a male thread part formed on an outer surface of an inlet of the elastic tube, wherein the upper flange is in contact with an upper end of the hollow actuator; and a lower flange screw-engaged with a male thread part formed on an outer surface of an outlet of the elastic tube, wherein the lower flange is in contact with a lower end of the hollow actuator.

7. The droplet dispensing apparatus in accordance with claim 1, wherein the outer diameter of the deforming part is smaller than that of an inlet and an outlet, and the outer surface of the deforming part is curved outward to form a convex cross section.

8. The droplet dispensing apparatus in accordance with claim 1, further comprising:

an upper flange screw-engaged with a male thread part formed on an outer surface of an inlet, wherein the upper flange is in contact with one end of the hollow actuator; and a lower flange extending outward from an outlet of the elastic tube, wherein the lower flange is in contact with the other end of the hollow actuator.

9. The droplet dispensing apparatus in accordance with claim 5, further comprising a discharge nozzle provided on the outlet of the elastic tube.

10. The droplet dispensing apparatus in accordance with claim 6, further comprising a discharge nozzle provided on the outlet of the elastic tube.

11. The droplet dispensing apparatus in accordance with claim 7, further comprising a discharge nozzle provided on the outlet of the elastic tube.

12. The droplet dispensing apparatus in accordance with claim 8, further comprising a discharge nozzle provided on the outlet of the elastic tube.

13. The droplet dispensing apparatus in accordance with claim 5, further comprising elastic molding injected between the elastic tube and the hollow actuator.

14. The droplet dispensing apparatus in accordance with claim 6, further comprising elastic molding injected between the elastic tube and the hollow actuator.

15. The droplet dispensing apparatus in accordance with claim 7, further comprising elastic molding injected between the elastic tube and the hollow actuator.

16. The droplet dispensing apparatus in accordance with claim 8, further comprising elastic molding injected between the elastic tube and the hollow actuator.

17. The droplet dispensing apparatus in accordance with claim 7, further comprising a backflow preventer provided on the inlet of the elastic tube.

18. The droplet dispensing apparatus in accordance with claim 8, further comprising a backflow preventer provided on the inlet of the elastic tube.

19. The droplet dispensing apparatus in accordance with claim 1, wherein the piezoelectric devices are stacked along the longitudinal direction.

20. The droplet dispensing apparatus of claim 1, wherein the piezoelectric devices are fitted around the elastic body such that the outer surface of the deforming part of the elastic body directly contacts an inner surface of the piezoelectric devices that bounds the hole of each of the piezoelectric devices when the hollow actuator is both expanded and contracted.

* * * * *